United States Patent [19]

Klima et al.

[11] Patent Number: 5,022,892

[45] Date of Patent: Jun. 11, 1991

[54] FINE COAL CLEANING VIA THE MICRO-MAG PROCESS

[75] Inventors: Mark S. Klima, Finleyville; Carl P. Maronde, McMurray; Richard P. Killmeyer, Pittsburgh, all of Pa.

[73] Assignee: United States Department of Energy, Washington, D.C.

[21] Appl. No.: 460,465

[22] Filed: Jan. 3, 1990

[51] Int. Cl.[5] ..... C10L 10/00

[52] U.S. Cl. ..... 44/621

[58] Field of Search ..... 44/621; 209/39, 1, 172.5, 209/8

[56] References Cited

U.S. PATENT DOCUMENTS

| | | | |
|---|---|---|---|
| 3,999,958 | 12/1976 | Iannicelli | 209/8 |
| 4,081,251 | 3/1978 | Colli | 209/8 |
| 4,133,747 | 1/1979 | Visman | 209/5 |
| 4,140,628 | 2/1979 | Horsfall | 209/172.5 |
| 4,345,994 | 8/1982 | Leonard et al. | 209/172.5 |
| 4,432,868 | 2/1984 | Aldrich | 209/172.5 |
| 4,470,901 | 9/1984 | Burgess | 209/172.5 |

*Primary Examiner*—Margaret B. Medley
*Attorney, Agent, or Firm*—Hugh W. Glenn; Robert J. Fisher; William R. Moser

[57] ABSTRACT

A method of cleaning particulate coal which is fed with a dense medium slurry as an inlet feed to a cyclone separator. The coal particle size distribution is in the range of from about 37 microns to about 600 microns. The dense medium comprises water and ferromagnetic particles that have a relative density in the range of from about 4.0 to about 7.0. The ferromagnetic particles of the dense medium have particle sizes of less than about 15 microns and at least a majority of the particle sizes are less than about 5 microns. In the cyclone, the particulate coal and dense-medium slurry is separated into a low gravity product stream and a high gravity produce stream wherein the differential in relative density between the two streams is not greater than about 0.2. The low gravity and high gravity streams are treated to recover the ferromagnetic particles therefrom.

15 Claims, 4 Drawing Sheets

FINE COAL CLEANING VIA THE MICRO-MAG PROCESS

CONTRACTUAL ORIGIN OF THE INVENTION

The United States Government has rights in this invention pursuant to the employer-employee relationship of the Government to the inventors as U.S. Department of Energy employees at the Pittsburgh Energy Technology Center.

BACKGROUND OF THE INVENTION

This invention relates to coal beneficiation and more particularly relates to a coal beneficiation method useful for cleaning coal wherein the coal particle size distribution is in the range of from about 37 microns to about 600 microns. It has been known in the prior art that various methods are used to clean coal having particle sizes from about 6300 microns to approximately 600 microns, that is to produce low ash and low sulfur fuels from coal of this size. In addition, some of these techniques have been applied to coal down to 150 microns in size with limited success.

However, except for froth flotation, no satisfactory commercial process exists for satisfactorily cleaning finer coal, that is in the range of from about 37 to about 150 microns.

Coal beneficiation has been useful to make coal a high quality, more flexible, and desirable fuel for new uses such as coal-water mixtures for utility or industrial boilers, dry particulate or slurry fuels for diesel or gas turbine applications, and for conventional applications such as electric utilities and export.

Producing such low-ash and low-sulfur fuels for these applications requires complete or near complete liberation of mineral matter from the coal. By mineral matter, it is intended to include ash as well as sulfur-bearing pyrite. Most often, this degree of liberation is realized only at particle sizes of less than 150 microns. However, few techniques exist for treating such ultrafine sizes of coal, and on a commercial basis, froth flotation has historically been the only technique used for cleaning fine coal down to a 37 micron fineness. Despite its widespread use, froth flotation is inefficient, especially at the finer particle sizes and is particularly poor or inefficient in rejecting pyrite from the cleaned coal product. This inherent inability to remove pyrite by the froth flotation process has become a severe detriment as concern for high sulfur emissions into the environment has increased.

Magnetite ($Fe_3O_4$) is widely used in dense-medium gravimetric processes. It is mixed with water to form a suspension with a relative density between 1.2 and 2.0—a dense medium. In general, commercial grades or size distributions of magnetite are used for beneficiation. For instance, grade E magnetite is about 95% less than 45 microns with about 25% less than 5 microns. Finer magnetite has not been used to clean coal successfully on a commercial scale. One South African article reported tests with finer magnetite, but they were unable to recover the magnetite at an acceptable level or to clean coal down to 37 microns.

Summary Of The Invention

Accordingly, it is an object of the present invention to provide a method for the beneficiation of coal fines in the range of between about 37 microns and about 600 microns and more particularly to a fine cut in the range of about 37 microns to about 100 microns using micronized particles such as magnetite, in a dense-medium suspension wherein 100% of the particles are smaller than 15 microns and at least 50% are smaller than 5 microns.

Another object of the present invention is to provide a method of cleaning coal, comprising providing a particulate coal and a dense-medium slurry inlet feed to a cyclone separator wherein the coal particle size distribution is in the range of from about 37 microns to about 600 microns, the dense medium including water and solid particles, heretofore referred to as "micronized-magnetite medium", having a relative density in the range of from about 1.2 to about 1.8, the ferromagnetic particles of the dense medium having a relative density in the range of from about 4.0 to about 7.0 and particle sizes of less than about 15 microns and at least a majority of the dense medium having particle sizes less than about 5 microns, separating the particulate coal and dense-medium slurry into a low gravity product stream and a high gravity product stream wherein the differential in relative density between the micronized-magnetite medium associated with the low gravity stream and the medium associated with the high gravity stream is not greater than about 0.2, and treating the low gravity and high gravity streams to separately recover the ferromagnetic particles therefrom.

Another object of the invention is to provide a method of cleaning coal, comprising providing a particulate coal-dense-medium slurry inlet feed to a cyclone separator wherein the coal particles are less than about 100 microns, the dense medium including water and ferromagnetic particles wherein the ferromagnetic particle size being 100% less than about 15 microns and the medium having a relative density greater than about 1.2, separating the inlet feed into a high gravity stream and a low gravity stream in the cyclone separator wherein the differential in relative density between the low gravity stream and the high gravity stream is not greater than about 0.2, and treating the high and low gravity streams with a high-gradient magnetic separator to recover greater than 99.5% by weight of the ferromagnetic particles with a purity greater than 90% by weight of the ferromagnetic particles.

The invention consists of certain novel features and a combination of process steps, named the Micro-Mag Process, hereinafter fully described, with data as illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying graphs and data, from an inspection of which, when considered in connection with the following description, the invention, its operation, and many of its advantages should be readily understood and appreciated.

DETAILED DESCRIPTION OF THE INVENTION

Figure 1:
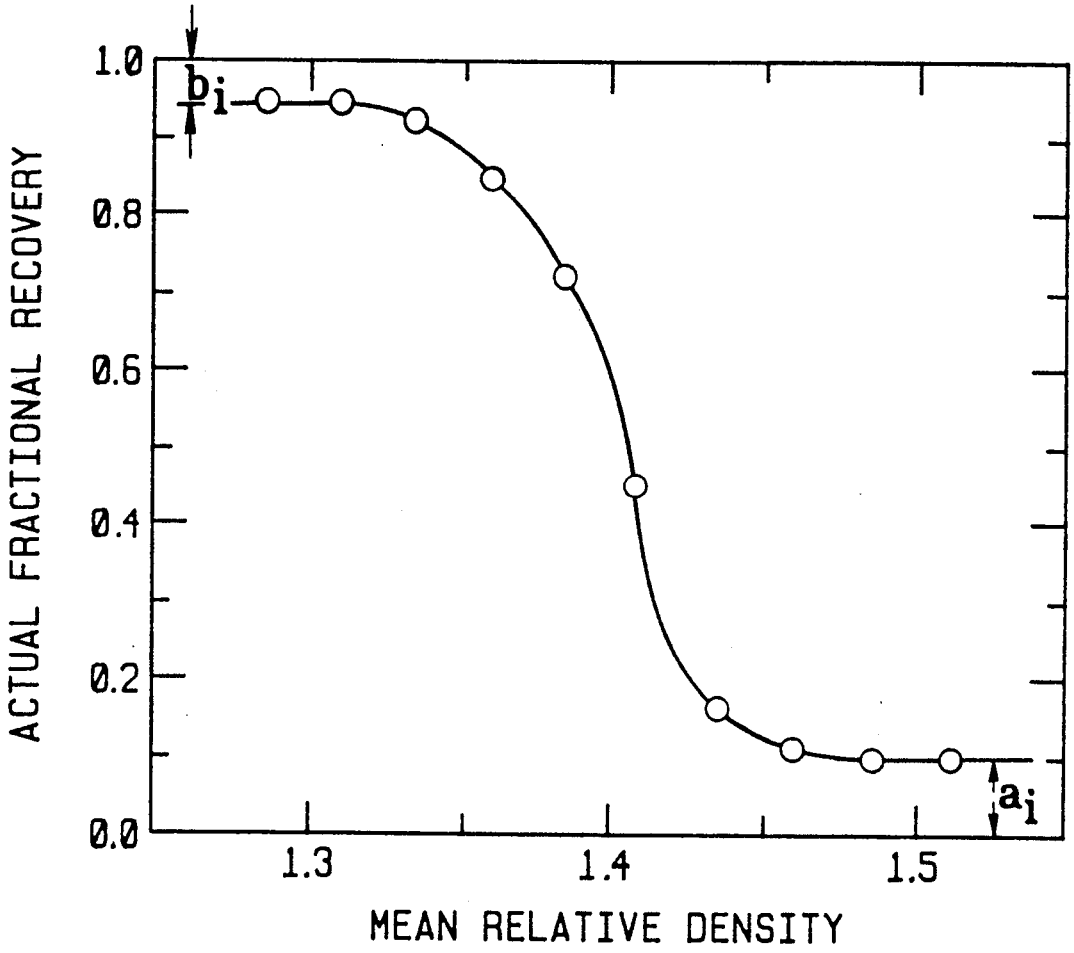
FIG. 1 is a graph illustrating an actual fractional recovery curve.

In order to clean coal with fine or micronized magnetite, it is necessary that the micronized magnetite be substantially finer than the smallest particles of coal processed. Since the inventive process is applicable to coal particles of about 37 microns, it is required that the media, such as micronized magnetite, be much smaller or finer. The media should be ferromagnetic, have a relative density of at least about 4.0, and be non-reactive with coal or water. In addition, the media should be non-toxic, inexpensive, non-corrosive, and in large, available supply. Two examples of acceptable media are FeSi and $Fe_3O_4$, which is preferred. Furthermore, the media size distribution should be selected to reduce the media segregation which occurs within the cyclone during operation. Under normal operating conditions using standard grades of magnetite, a relative density differential exists between the overflow and underflow mediums which is attributable to the classification of the magnetite within the cyclone resulting from the high centrifugal forces generated within the cyclone. This condition contributes to separation inefficiency and is substantially avoided when the magnetite or media is sufficiently fine. In fact, the differential in relative density between the overflow and the underflow should be and can be maintained at 0.2 or less to achieve a sharp separation of fine coal. The use of micronized magnetite allows this to occur. However, if the magnetite is too fine, then an undesirable viscosity increase occurs and recovery of the magnetite becomes problematic. To prepare the micronized magnetite useful in the present invention, grade B magnetite, having the size distribution given in Table 1, was ground in a continuously-fed vertical stirred ball mill and the product from this mill was reintroduced or recycled to the mill a number of times to obtain the size distributions set forth in Table 1. In addition, grade B magnetite was ground in a jetmill, and then further ground in a batch vertical stirred ball mill. The size distribution used in the majority of the testing was that prepared from the jetmill product which had been further ground in the ball mill for two hours. This micronized magnetite had a top size of approximately 8 microns and is designated MM1 in Table 2. However, magnetite with a top size of about 15 microns with a majority having a size of 5 microns or less may also be an acceptable media. The cyclone testing of the micronized magnetite was conducted under various operating conditions using both 50-mm and 25-mm diameter Mozley hydrocyclones. The test assembly was a complete unit equipped with pump, motor, sump, cyclones, and appropriate orifices. The cyclone inlet pump was supplied with a bypass valve allowing for variation of inlet pressures. The test conditions are listed in Table 3.

The feed coal used for the cyclone tests was prepared by first passing minus-600-micron bituminous coal through a high-speed hammer mill. The product was then wet screened at 100, 75, 53 and 45 microns to produce the desired, narrowly spaced, size fractions utilized. Prior to performing each cyclone run, the appropriate weights of micronized magnetite, water, and coal were determined. Each test was run using a constant volume of 8000 cc for the magnetite and water mixture, that is the dense medium, along with 500 grams of the desired size fraction of coal. This mixture resulted in a medium-to-coal weight ratio of about 22 to 1 for a weight percent of solids of about 4.4%. Medium-to-coal ratios of from about 15:1 to about 4:1 are acceptable loadings for the present invention. However, in the test runs, this percentage was purposely kept low to minimize extraneous effects which might be present due to a high solids concentration. The magnetite and coal slurry were added to the sump and circulated through the cyclone for one minute. Cyclone overflow and underflow streams were then sampled simultaneously by diverting each entire stream into separate beakers. After being sampled, the slurry in each beaker was washed over a 38 micron screen to remove the magnetite and recover the overflow and underflow coal samples. These samples were then dried and weighed to obtain the mass yield and then subjected to a float-sink analysis. Using the data from this analysis, along with the mass yield, the relative density distribution of the feed stream was determined.

Figure 2:
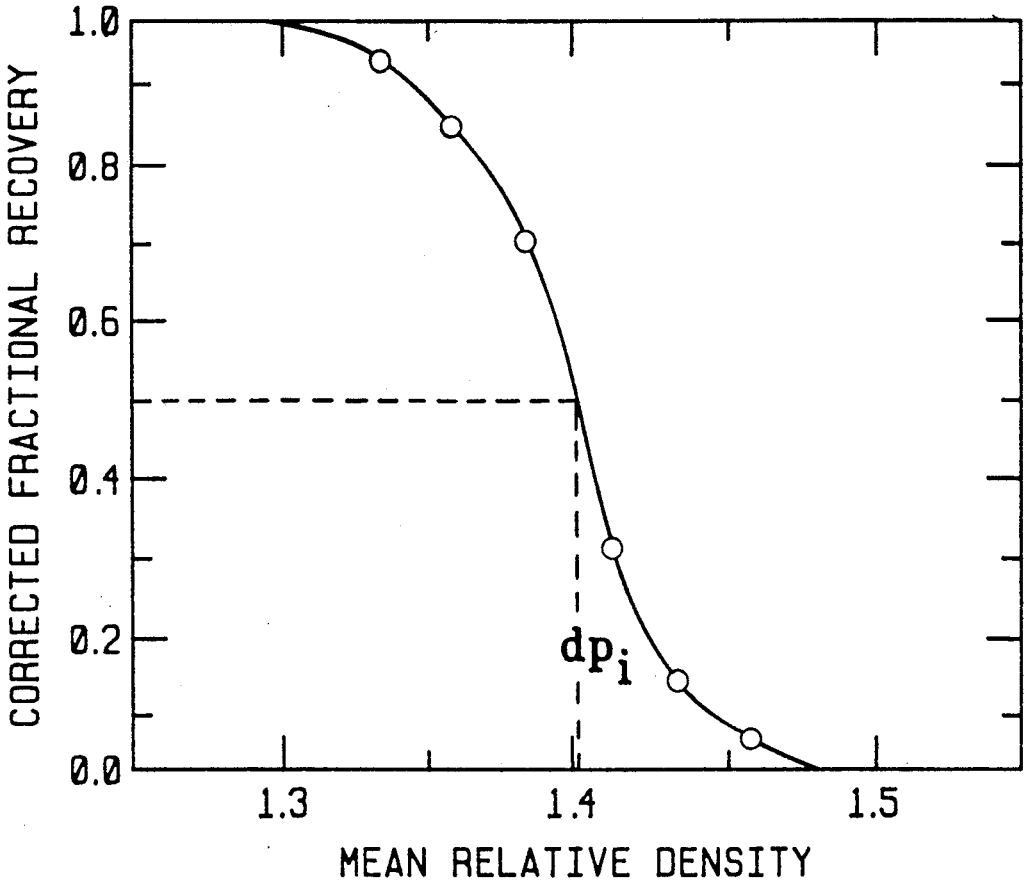
FIG. 2 is a graph illustrating a corrected fractional recovery curve.

The initial results of testing using micronized magnetite are presented in Table 3. Of importance in Table 3 are the material bypass parameters, a and b; relative density of separation, dp, and the mean probable error, ep. The material bypass parameters, a and b, are defined as those fractions of feed material that bypass or short circuit to the clean coal (low gravity stream) and refuse streams (high gravity stream), independent of the separating action, see FIG. 1. The relative density of separation is defined as the relative density corresponding to 0.5 on the corrected fractional recovery curve, (see FIG. 2), while the mean probable error is defined as:

$$ep = 0.5\ (rd_{25} - rd_{75})$$

where $rd_{25}$ = relative density corresponding to 0.25 on the corrected fractional recovery curve $rd_{75}$ = relative density corresponding to 0.75 on the corrected fractional recovery curve.

Figure 3:
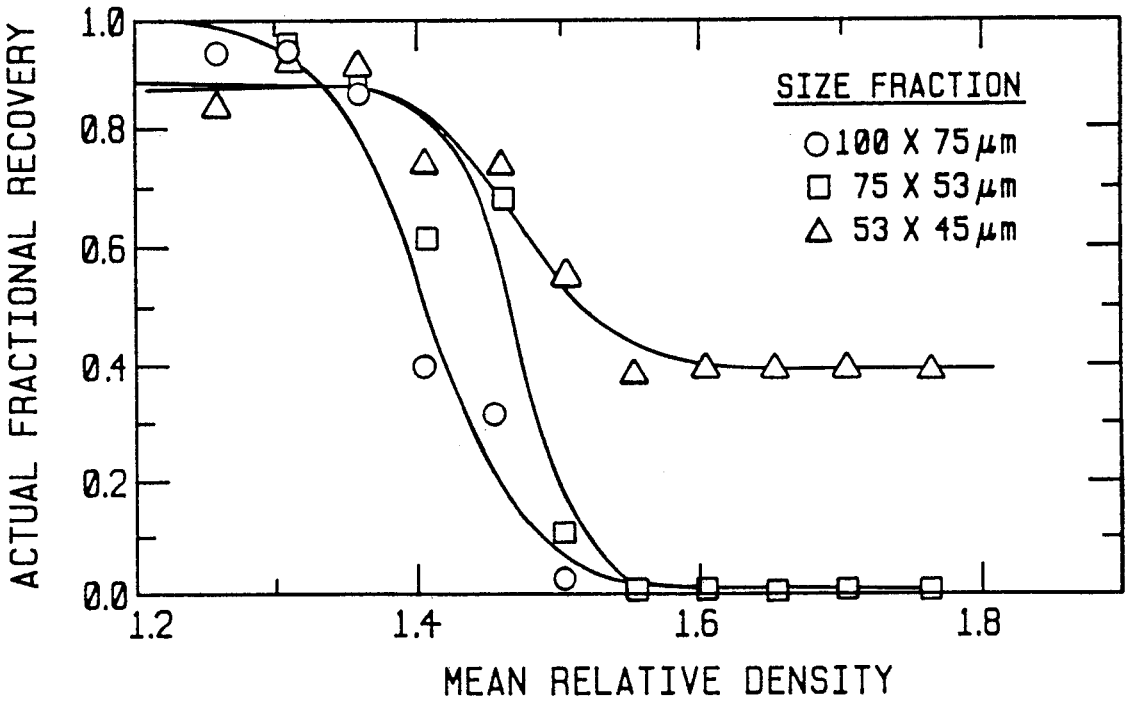
FIG. 3 is a graph illustrating the resultant fractional recovery curves from the 50-mm-diameter cyclone separating various size fractions of coal.

Tests 1–3 were performed to evaluate the effect on the separation efficiency in the 50-mm-diameter cyclone using various size fractions of coal (see FIG. 3). Although the 100×75 micron size fraction separated at the lowest dp value, the ep value actually was somewhat higher than that of the 75×53 micron size fraction and the same as that of the 53×45 micron size fraction (see Table 3). However, of equal or greater importance, no material bypassing occurred in the 100×75 micron size fraction, while a b-bypass was present in the 75×53 micron size fraction. In addition, both overflow and underflow bypasses were present in the finest size fraction.

Figure 4:
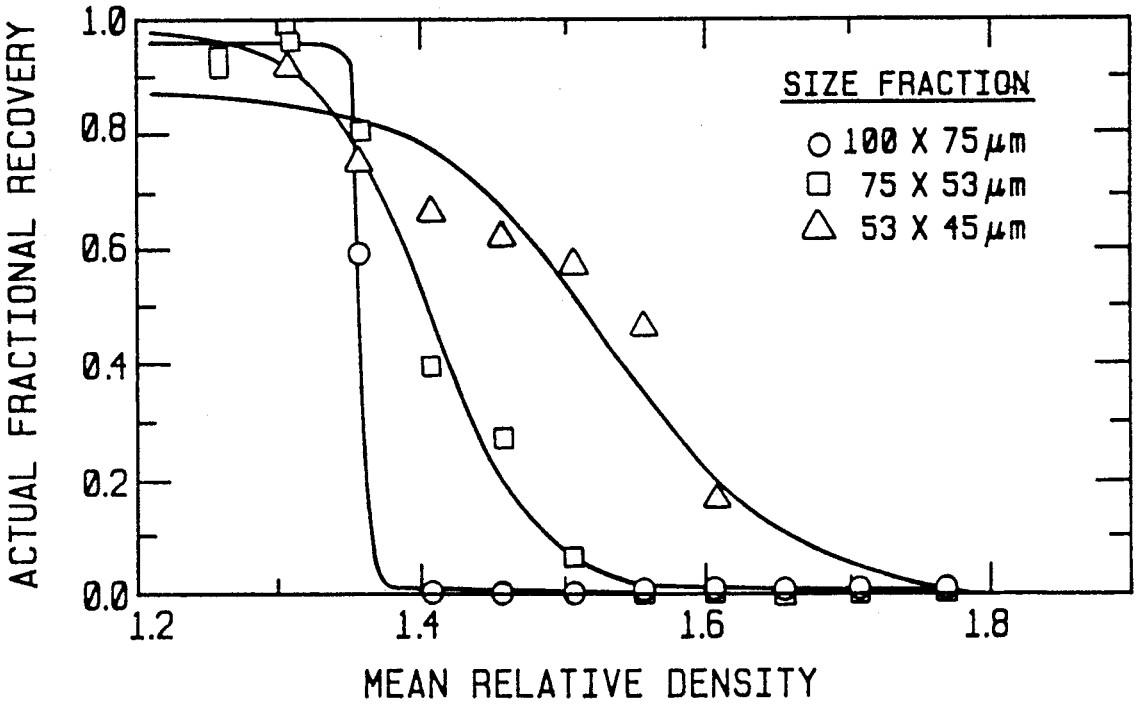
FIG. 4 is a graph illustrating the resultant fractional recovery curves from the 25-mm-diameter cyclone separating various size fractions of coal.

Tests 4–6 were performed to evaluate the effect on the separation efficiency in the smaller 25-mm-diameter cyclone using the same three size fractions of coal (see FIG. 4). The sharpest separation occurred in the 100×75 micron size fraction as indicated by the ep value, which approached that of a perfect separation (see Table 3). The dp value was nearly the same as the medium relative density, while only a b-bypass was present. Likewise, only a small b-bypass was observed for the 75×53 micron size fraction, but both dp and ep were greater. The 53×45 micron size fraction not only had the largest dp and ep values, as expected, but a b-bypass was also present.

Tests 7-9 were performed to evaluate the effect on the separation efficiency in the 50-mm-diameter cyclone using various media size distributions. In test 7, the standard micronized-magnetite grade, MM1 was flocculated magnetically prior to testing, resulting in a coarser grade, MM2 (see Table 2). The characteristic parameters that resulted from using this magnetite to beneficiate the 100×75 micron size fraction of coal are given in Table 3 and are compared to those generated in test 1. Note that both dp and ep have increased, indicating that the shear forces present within the 50-mm-diameter cyclone were not of sufficient magnitude to disperse the flocculated magnetite. As a result, the media particles were no longer separate entities but rather agglomerates that impeded the movement of the coal particles through the medium and by virtue of this coarser size distribution was a less homogeneous dense medium as realized from a coal particle perspective. Therefore, micronized magnetite, which has been recovered magnetically, may need to be dispersed either by demagnetization or by the proper reagents prior to reusing it as the separating medium.

Tests 8 and 9 were run with the 75×53 micron size fraction of coal and grades of micronized magnetite coarser (grades MM3 and MM4) than grade MM1 (See Table 2). Grade MM3 corresponded to grade B magnetite, which had been ground in the batch stirred ball mill for 35 minutes. On the other hand, grade MM4 was produced by wet screening grade B magnetite at 38 microns. The separation obtained with grade MM4 (test 9) gave a much higher dp, value than with grade MM1 (test 1) with both a and b bypasses present (see Table 3). However, the mean probable error was less than that with the finest grade. A similar occurrence was observed for Grade MM3 (test 8). In this case, the relative density of separation falls between the other two grades, as does the mean probable error, while material bypassing appears to be more prevalent. Additional testing will need to be conducted to help explain these findings.

Test 10 was performed to evaluate the effect of separating the 100×75 micron coal fraction at a lower medium relative density in the 25-mm-diameter cyclone (see Table 3). Even though the separation at the lower medium relative density (test 10) did not match the nearly ideal separation at the higher medium relative density (test 4), the parameters obtained for test 10 were still very good. The relative density of separation was only somewhat higher than the medium relative density, while the mean probable error was low. However, unlike in test 4, an apparent b-bypass of nearly 20% was obtained.

Finally, test 11 was performed to evaluate the effect of separating the 100×75 micron coal fraction at a lower inlet pressure in the 50-mm-diameter cyclone (see Table 3). In this case, the separation at the lower pressure (test 11) was much worse than for test 1 as indicated by the higher dp, ep and material bypass values. Because of the fineness of the micronized magnetite, a larger inlet pressure, and hence, greater centrifugal force was needed to overcome the viscosity of the medium. This also showed that the negative aspects of a higher inlet pressure, i.e., decreased retention time, increased mixing, and a change in the pulp split, seemed to be offset by the increased magnitude of the centrifugal force.

Table 5 is a comparison of mean probable errors calculated from various published data. Generally, the coarser the coal, the lower the ep values, and the finer the coal, the higher the ep values. Ep values range from 0 to 1 with 0 being perfect. Other than runs 7 and 8 which represent the inventive process, the best cleaning of finer particles was according to the South African reference, but even here coarse material between 600 and 75 microns were present and there is no mechanism to determine how much coarse material was present. The ep values are acceptable but can not be extrapolated to finer material, because as noted, the finer the material the higher the ep values. Run 7 for the 100×75 micron size fraction is by far the best cleaning reported, but all of the U.S. DOE Micro-Mag Process values are acceptable.

After each cyclone test, the magnetite was separated from the coal simply by washing the overflow and underflow samples on a 38-micron screen. The use of standard wet-drum magnetic separators are apparently unsatisfactory due to the fineness of the magnetite. In fact, some tests indicated that only 70-80% of the micronized-magnetite could be recovered using a wet drum in a single pass. Hence, a matrix-type separator was used. A Sala high-gradient magnetic separator (HGMS) is capable of generating background magnetic fields up to 2 Tesla with high local-field gradients resulting in exceptionally high separating forces. In comparison, wet-drum separators employed in most coal plants are only capable of producing background magnetic fields less than 0.3 Tesla with low local-field gradients.

Sixteen HGMS runs, including replicates, were performed as base-line tests to investigate the effect of magnetic-field strength on the recovery of the micronized magnetite. The size distribution of the micronized magnetite corresponded to grade MM1 (see Table 2) and contained about 91% magnetics, as measured with a Davis tube. The first 10 tests were carried out using mixtures of micronized magnetite and water, 595 g and 13,405 g of each, respectively. For each of the final 6 tests, an additional 100 g of 100×38 micron coal was added. The HGMS test conditions are given in Table 4. For each mix, with and without coal, tests run at the same field strength were replicates.

At the start of each test, the HGMS magnet was energized. The feed slurries were then gravity fed for 10 seconds from the feed tank through a canister, 80-mm-diameter by 150-mm-long, containing a matrix of expanded metal screens having approximately 6-mm openings, which were oriented perpendicular to the flow. Because the canister was situated within the magnetic field, the micronized magnetite was captured in the matrix while the nonmagnetic material passed into a separate container. With the magnet still energized, the magnetite was rinsed for 10 seconds to wash away any trapped impurities. Finally, the magnet was deenergized allowing the magnetite to be flushed out of the canister. This last sequence also took 10 seconds to complete. The recovered magnetic and nonmagnetic fractions were then saved and a Davis tube was used to determine the percent magnetics in each of these fractions.

The mass yields for the nonmagnetic and magnetic fractions as well as the corresponding grades (as denoted by the percent magnetics) and the percent of micronized magnetite recovered for the 16 HGMS tests, are given in Table 4. For tests 1-10 (no coal added), the percent of micronized magnetite recovered increased slightly as the magnetic field strength increased. Furthermore, the magnetite recoveries exceeded 99.9% in all cases except for test 2, which was run at the lowest magnetic field. Correspondingly, the purity was greater than 90% by weight magnetics in all cases. The minimum recovery for a commercially viable process is about 99.5% magnetite recovery that is substantially coal free.

Tests 11–16 were carried out at the two higher magnetic fields, all with coal added. For these tests, the micronized magnetite recoveries were also higher at the highest magnetic field. However, the percent of magnetite recovered was somewhat less than that for those tests with no coal added, an indication that the coal interfered with the magnetite recovery. These results show that high micronized-magnetite recoveries are possible with a matrix-type separator.

Accordingly, it has been shown that magnetite on the order of about minus 10 microns has the ability to clean fine coal of less than 100 microns via a micronized-magnetite cycloning process in which very high micronized-magnetite recoveries are possible using an HGMS system.

While there has been disclosed what is considered to be the preferred embodiment of the present invention, it is understood that various changes in the details may be made without departing from the spirit, or sacrificing any of the advantages of the present invention.

TABLE 1

Size Distributions of the Feed and Product Magnetite After Various Passes Through the 1300-cc PERL Mill (Ball Diameter = 2.0 mm; Ball Charge-5,000 g; Shaft Speed = 1500 rpm; Wt. % Solids = 75; Slurry Feed Rate = 7.8 cc/s)

| Microtrac | % Less Than Size After Each Pass | | | | | | |
|---|---|---|---|---|---|---|---|
| Size (μm) | O (Feed) | 1 | 2 | 3 | 4 | 5 | 6 |
| 88 | 100. | 100. | 100. | 100. | 100. | 100. | 100. |
| 62 | 91.7 | 100. | 100. | 100. | 100. | 100. | 100. |
| 44 | 80.7 | 100. | 100. | 100. | 100. | 100. | 100. |
| 31 | 67.8 | 100. | 100. | 100. | 100. | 100. | 100. |
| 22 | 53.9 | 99.9 | 100. | 100. | 100. | 100. | 100. |
| 16 | 43.3 | 96.6 | 100. | 100. | 100. | 100. | 100. |
| 11 | 31.7 | 87.2 | 96.6 | 100. | 100. | 100. | 100. |
| 7.8 | 23.2 | 71.1 | 84.6 | 92.7 | 97.3 | 99.2 | 100. |
| 5.5 | 17.9 | 50.3 | 64.7 | 76.4 | 85.7 | 90.3 | 94.5 |
| 3.9 | 10.3 | 29.2 | 39.1 | 48.2 | 56.6 | 61.6 | 66.0 |
| 2.8 | 4.3 | 12.7 | 17.8 | 22.3 | 26.8 | 31.2 | 34.1 |

TABLE 2

Size Distributions of the Various Grades of Micronized Magnetite Used in the Cyclone Testing

| Microtrac | % Less Than Size for Each Grade | | | |
|---|---|---|---|---|
| Size (μm) | MM1 | MM2 | MM3 | MM4 |
| 62 | 100. | 100. | 100. | 100. |
| 44 | 100. | 100. | 100. | 97.9 |
| 31 | 100. | 100. | 100. | 87.5 |
| 22 | 100. | 100. | 100. | 70.9 |
| 16 | 100. | 99.0 | 99.7 | 55.6 |
| 11 | 100. | 94.5 | 94.5 | 41.5 |
| 7.8 | 100. | 79.2 | 83.7 | 30.2 |
| 5.5 | 91.5 | 56.2 | 65.0 | 21.6 |
| 3.9 | 60.3 | 31.5 | 38.6 | 11.8 |
| 2.8 | 29.6 | 12.6 | 16.6 | 5.0 |

TABLE 3

Test Conditions for the Micronized-Magnetite Cycloning (50-mm-diameter cyclone: overflow = 14.3 mm: underflow = 7.94 mm; inlet = 6.35 × 11.1 mm: 25-mm-diameter cyclone: overflow = 6.35 mm: underflow = 4.76 mm: inlet = 4.85 mm)

| Test | Cyclone Dia. (mm) | Inlet Pressure (kPa) | Medium Rel. Den. | Coal Size Fraction (μg) | MMag.* Grade | Characteristic Parameters dpi | epi | ai | bi |
|---|---|---|---|---|---|---|---|---|---|
| 1 | 50 | 138 | 1.35 | 100 × 75 | MM1 | 1.406 | 0.041 | 0.000 | 0.000 |
| 2 | 50 | 138 | 1.35 | 75 × 53 | MM1 | 1.472 | 0.025 | 0.000 | 0.121 |
| 3 | 50 | 138 | 1.35 | 53 × 45 | MM1 | 1.471 | 0.040 | 0.393 | 0.110 |
| 4 | 25 | 276 | 1.35 | 100 × 75 | MM1 | 1.357 | 0.003 | 0.000 | 0.040 |
| 5 | 25 | 276 | 1.35 | 75 × 53 | MM1 | 1.403 | 0.042 | 0.000 | 0.016 |
| 6 | 25 | 276 | 1.35 | 53 × 45 | MM1 | 1.530 | 0.069 | 0.000 | 0.124 |
| 7 | 50 | 138 | 1.35 | 100 × 75 | MM2 | 1.495 | 0.080 | 0.039 | 0.008 |
| 8 | 50 | 138 | 1.35 | 75 × 53 | MM3 | 1.530 | 0.027 | 0.212 | 0.089 |
| 9 | 50 | 138 | 1.35 | 75 × 53 | MM4 | 1.570 | 0.014 | 0.034 | 0.065 |
| 10 | 25 | 276 | 1.25 | 100 × 75 | MM1 | 1.309 | 0.019 | 0.000 | 0.193 |
| 11 | 50 | 69 | 1.35 | 100 × 75 | MM1 | 1.440 | 0.097 | 0.173 | 0.078 |

*Micronized Magnetite

TABLE 4

Test Conditions and Results for Micronized-Magnetite Recovery Using a High-Gradient Magnetic Separator (Feed Rate = 440 cc/s; Rinse Rate = 240 cc/s; Flush Rate = 990 cc/s)

| Test | Mag. F.S.[1] (Tesla) | % Yield Nonmag.[2] | % Yield Mag.[3] | % Grade Nonmag. | % Grade Mag. | % MMag.[4] Recovered |
|---|---|---|---|---|---|---|
| 1 | 0.2 | 3.8 | 96.2 | 2.4 | 94.2 | 99.90 |
| 2 | 0.2 | 3.9 | 96.1 | 6.5 | 93.8 | 99.72 |
| 2 | 0.4 | 3.8 | 96.2 | 1.4 | 93.9 | 99.94 |
| 4 | 0.4 | 4.1 | 95.9 | 1.3 | 94.4 | 99.94 |
| 5 | 0.4 | 4.4 | 95.6 | 1.8 | 94.3 | 99.91 |
| 6 | 0.9 | 3.5 | 96.5 | 1.0 | 95.0 | 99.96 |
| 7 | 0.9 | 3.8 | 96.2 | 1.0 | 95.3 | 99.96 |
| 8 | 0.9 | 3.2 | 96.8 | 0.9 | 96.1 | 99.97 |
| 9 | 0.9 | 4.1 | 95.9 | 1.1 | 95.1 | 99.95 |
| 10 | 0.9 | 4.4 | 95.6 | 0.7 | 94.8 | 99.97 |
| 11 | 0.4 | 15.9 | 84.1 | 2.1 | 93.5 | 99.58 |
| 12 | 0.4 | 15.3 | 84.7 | 1.7 | 93.2 | 99.67 |
| 13 | 0.4 | 16.8 | 83.2 | 3.5 | 93.6 | 99.25 |
| 14 | 0.9 | 16.1 | 83.9 | 1.1 | 92.4 | 99.77 |
| 15 | 0.9 | 16.2 | 83.8 | 1.0 | 92.1 | 99.79 |
| 16 | 0.9 | 14.5 | 85.5 | 0.6 | 91.9 | 99.89 |

[1]Mag. F.S. = Magnetic Field Strength;
[2]Nonmag. = Nonmagnetic Fraction;
[3]Mag. = Magnetic Fraction;
[4]MMag. = Micronized Magnetite

TABLE 5

MEAN PROBABLE ERROS FOR VARIOUS FINE-COAL DENSE-MEDIUM CYCLONES

| APPROXIMATE SIZE FRACTION (MICRONS) | CYCLONE OPERATION 1 | 2 | 3 | 4 | 5 | 6 | 7 | 8 |
|---|---|---|---|---|---|---|---|---|
| 600 × 300 | 0.034 | 0.027 | 0.019 | — | — | — | — | — |

TABLE 5-continued

MEAN PROBABLE ERROS FOR VARIOUS FINE-COAL DENSE-MEDIUM CYCLONES

| APPROXIMATE SIZE FRACTION (MICRONS) | CYCLONE OPERATION 1 | 2 | 3 | 4 | 5 | 6 | 7 | 8 |
|---|---|---|---|---|---|---|---|---|
| 300 × 200 | 0.038 | 0.044 | 0.030 | 0.048 | 0.065 | — | — | — |
| 200 × 150 | 0.064 | 0.056 | — | — | — | 0.025 | — | — |
| 150 × 100 | 0.103 | 0.081 | 0.055 | — | — | — | — | — |
| 100 × 75 | — | — | 0.078 | — | — | — | 0.003 | 0.041 |
| 75 × 53 | — | — | — | — | — | — | 0.042 | — |
| 53 × 45 | — | — | — | — | — | — | 0.069 | — |

1 USBM-Daurbrouck (1974)
2 Marrowbone-Skoinik (1980)
3 South Africa-King, et al (1984)
4 Homer City-Chadgy, et al (1986)
5 Childress-Bauagartner (1978)
6 South Africa-Fouris, et al (1980)
7 USDOE-Micro-Mag Process, 25-mm diameter cyclone (1989)
8 USDOE-Micro-Mag Process, 50-mm diameter cyclone (1989)

The embodiments of the invention in which an exclusive property or privilege is claimed are defined as follows:

1. A method of cleaning coal, comprising providing a particulate coal and a dense-medium slurry inlet feed to a cyclone separator wherein the coal particle size distribution is in the range of from about 37 microns to about 600 microns, the dense medium including water and ferromagnetic particles has a medium relative density in the range of from about 1.2 to about 1.8, the ferromagnetic particles of the dense medium having a relative density in the range of from about 4.0 to about 7.0 and 100% of the particle size are less than about 15 microns and at least 50% of the dense medium has particle sizes less than about 5 microns, separating the particulate coal and dense medium slurry into a low gravity product stream and a high gravity product stream wherein the differential in relative density between the micronized-magnetite medium associated with the low gravity stream and the micronized-magnetite medium associated with the high gravity stream is not greater than about 0.2, and treating the low gravity and high gravity streams to separately recover the ferromagnetic particles therefrom.

2. The method of claim 1, wherein the coal particle size distribution is in the range of from about 100 microns to about 37 microns.

3. The method of claim 1, wherein the coal particle size distribution is in the range of about 100 microns to about 75 microns.

4. The method of claim 1, wherein the coal particle size distribution is in the range of from about 75 microns to about 53 microns.

5. The method of claim 1, wherein the coal particle size distribution is in the range of about 53 microns to about 37 microns.

6. The method of claim 1, wherein the ferromagnetic particles in the dense medium are $Fe_3O_4$.

7. The method of claim 1, wherein the ferromagnetic particles in the dense medium are FeSi.

8. The method of claim 6, wherein the recovery of magnetic particles from the high and low gravity streams is greater than 99.5% by weight with a purity greater than 90% by weight magnetics.

9. The method of claim 8, wherein the $Fe_3O_4$ particles are recovered with a high-gradient magnetic separator such that greater than about 99.5% by weight of the $Fe_3O_4$ particles are recovered with a purity greater than 90% by weight magnetics from the high and low gravity streams.

10. A method of cleaning coal, comprising providing a particulate coal-dense medium slurry inlet feed to a cyclone separator wherein the coal particles are less than about 100 microns, the dense medium including water and ferromagnetic particles wherein the ferromagnetic particle size being 100% less than about 15 microns and at least 50% of the ferromagnetic particles are less than about 5 microns, and the medium having a relative density greater than about 1.2, separating the inlet feed into a high gravity stream and a low gravity stream in the cyclone separator wherein the differential in relative density between the low gravity stream and the high gravity stream is not greater than about 0.2, and treating the high and low gravity streams with a high-gradient magnetic separator to recover greater than 99.5% by weight of the ferromagnetic particles with a purity greater than 90% by weight magnetics.

11. The method of claim 10, wherein the coal particle size distribution is from about 37 microns to about 100 microns.

12. The method of claim 10, wherein the ferromagnetic particles are more than 50% less than about 5 microns.

13. The method of claim 12, wherein the ferromagnetic particles are $Fe_3O_4$.

14. The method of claim 12, wherein the ferromagnetic particles are FeSi.

15. The method of claim 10, wherein medium relative density is between about 1.2 and 1.8.

* * * * *